US006481393B1

(12) United States Patent
Drew

(10) Patent No.: US 6,481,393 B1
(45) Date of Patent: Nov. 19, 2002

(54) INTERNAL COMBUSTION ENGINE WITH COMPOUND PISTON ASSEMBLY

(76) Inventor: Julius Drew, 3310 Cotton Mill Dr., Apt. 301, Raleigh, NC (US) 27612

( * ) Notice: Subject to any disclaimer, the term of this patent is extended or adjusted under 35 U.S.C. 154(b) by 0 days.

(21) Appl. No.: 09/964,003

(22) Filed: Sep. 26, 2001

(51) Int. Cl.[7] ..... F02B 75/18
(52) U.S. Cl. ..... 123/56.1; 123/45 A
(58) Field of Search ..... 123/56.1, 56.3, 123/45 R, 45 A, 57.1, 58.5, 58.6

(56) References Cited

U.S. PATENT DOCUMENTS 3,638,623 A * 2/1972 Weinheimer ..... 123/45 R
3,786,790 A * 1/1974 Plevyak ..... 123/56.2
4,462,345 A * 7/1984 Routery ..... 123/197.4

* cited by examiner

*Primary Examiner*—Tony M. Argenbright
*Assistant Examiner*—Katrina B. Harris
(74) *Attorney, Agent, or Firm*—Jack Schuman

(57) ABSTRACT

Compound piston assembly in cylinder of engine has small diameter piston engaging central bore in cylinder head mounted within cylinder and large diameter piston engaging cylinder. Swash plate, secured to drive shaft, engages large diameter piston. Two such engines may be mounted in opposition, engaging opposite faces of the swash plate. Alternatively, compound piston assembly is reciprocated in cylinder by crank operated by cam on drive shaft.

17 Claims, 6 Drawing Sheets

INTERNAL COMBUSTION ENGINE WITH COMPOUND PISTON ASSEMBLY

BACKGROUND OF THE INVENTION

1. Field of the Invention

This invention relates, broadly speaking, to a novel internal combustion engine and to a novel piston assembly therefor.

More particularly, this invention relates to a novel two-cycle internal combustion engine and to a novel compound piston assembly therefor.

2. Description of the Prior Art

Two-cycle internal combustion engines have long been known, sold and used. None, to the knowledge of the present inventor, embody the particular novel design of the present invention.

Pistons for internal combustion engines have long been known, sold and used. None, to the knowledge of the present inventor, embody the novel design of the compound piston assembly of the present invention.

SUMMARY OF THE PRESENT INVENTION

One of the objects of the present invention is to provide an improved two-cycle internal combustion engine which, with an improved piston assembly, has fewer parts than conventional two-cycle internal combustion engines and is therefor more economical to construct, and which is more efficient to operate than presently available two-cycle internal combustion engines.

Another of the objects of this invention is to provide an improved two-cycle internal combustion engine in which the piston in one of the cycles drives, and alternatively in the other of the cycles is driven by, a swash plate (also known as a wobble plate) connected to the drive shaft, and in another embodiment by a rod operatively connected to a cam on the drive shaft.

Yet another of the objects of this invention is to provide a dual two-cycle engine assembly in which two of the novel engines of this invention may be opposed in opposition against a single interposed swash plate.

Still other and further objects of the present invention will become apparent by reference to the accompanying specification and drawings, and to the appended claims.

Briefly, the foregoing objects are attained by providing a two-cycle internal combustion engine comprising a cylinder, a cylinder head mounted within the cylinder, and a compound piston assembly comprising a small diameter piston slidably engaging through piston rings a bore in the cylinder head, and a large diameter hollow piston slidably engaging through piston rings the inside wall of the cylinder. The drive shaft of the engine extends through the hollow large diameter piston and through a bore extending through the small diameter piston of the compound piston assembly. A swash plate secured to the drive shaft engages roller bearings rotatably mounted to and inside the hollow large diameter piston of the compound piston assembly. The compound piston assembly moves, or is moved depending upon the particular cycle of the operation, longitudinally within the cylinder by contact through the roller bearings with the swash plate. Rotation of the swash plate causes, or is caused by, rotation of the drive shaft. Approriate apertures are provided in the cylinder and in the cylinder head for introduction of a fuel/air mixture and for the discharge of exhaust gases. In an alternative embodiment, the drive shaft is provided with a cam portion engaging a crank which extends into the hollow large diameter piston of the compound piston assembly. A rod mounted to and within the hollow large diameter piston extends through an aperture in the crank. Longitudinal movement of the crank causes, or is caused by, longitudinal movement of the compound piston assembly within the cylinder, and by virtue of the cam portion on the drive shaft, rotation of the drive shaft results. In this embodiment, the drive shaft does not extend through a bore in the small diameter piston of the compound piston assembly, but rather through lateral apertures in the cylinder wall. In yet another embodiment, two engines of similar construction are arranged in opposition about a single swash plate. The hollow large diameter pistons of their respective compound piston assemblies engage, through their respective roller bearings, opposite sides of the single interposed swash plate which is secured to a drive shaft extending through the hollows of their respective large diameter pistons and through bores in their respective small diameter pistons.

DESCRIPTION OF THE DRAWINGS

Referring now to the drawings, in which like numerals represent like parts in the several views.

DESCRIPTION OF THE PREFERRED EMBODIMENTS

Figure 1:
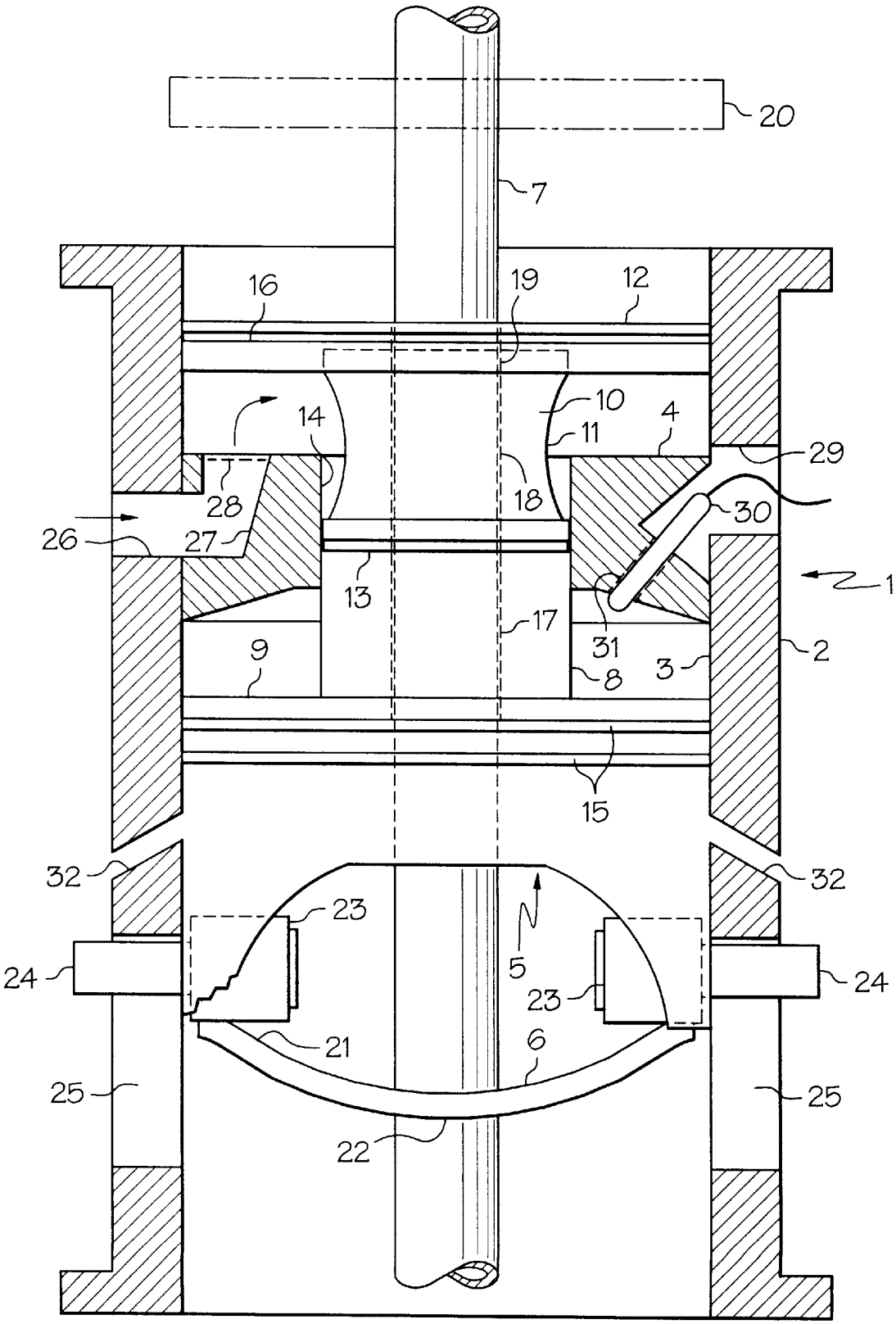
FIG. 1 represents a longitudinal medial view, partially in section, of the engine, showing the compound piston assembly at the top of its stroke.
Figure 2:
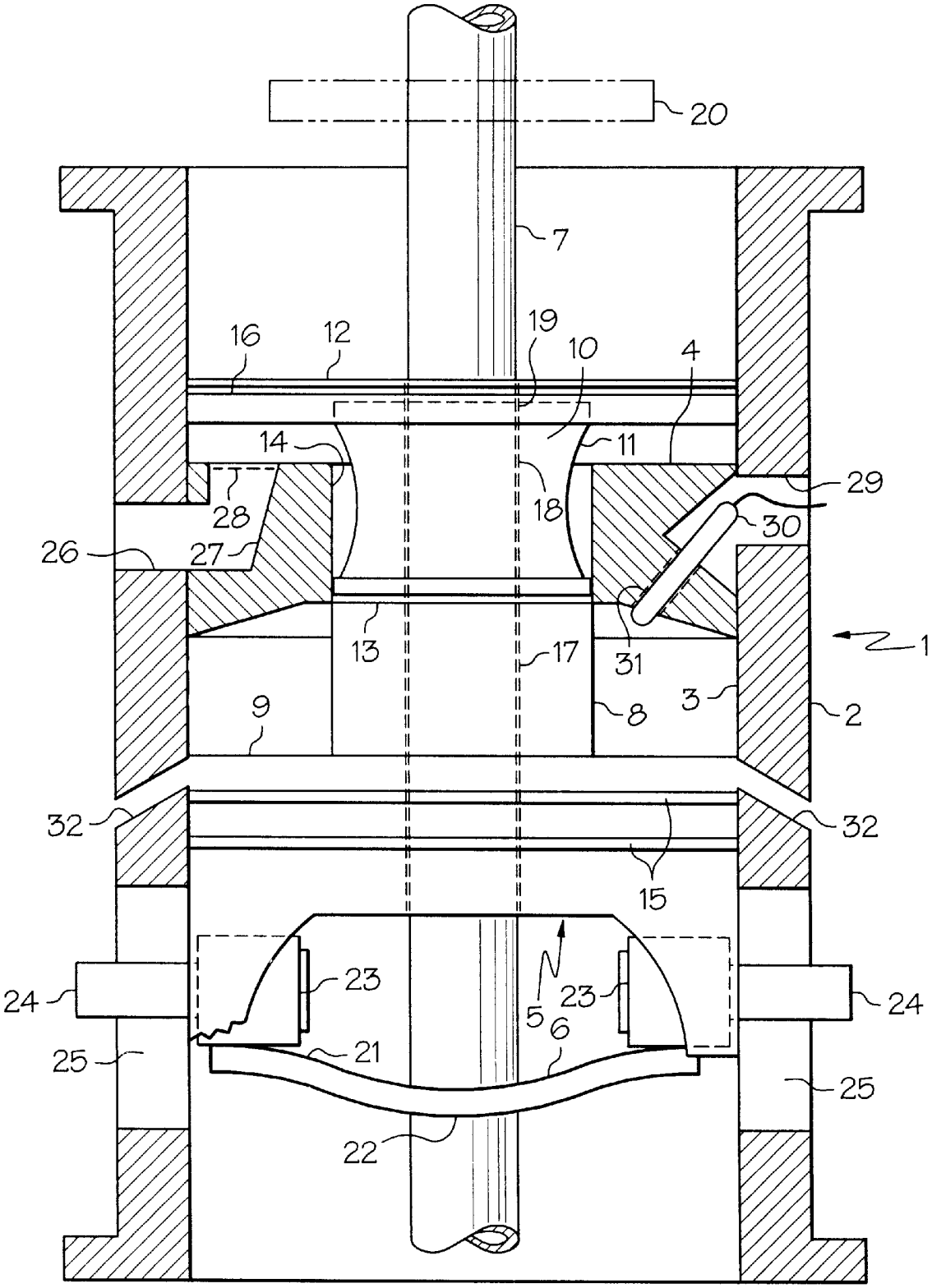
FIG. 2 represents a longitudinal view, partially in section, of the engine, similar to FIG. 1, showing the compound piston assembly in an intermediate position.
Figure 3:
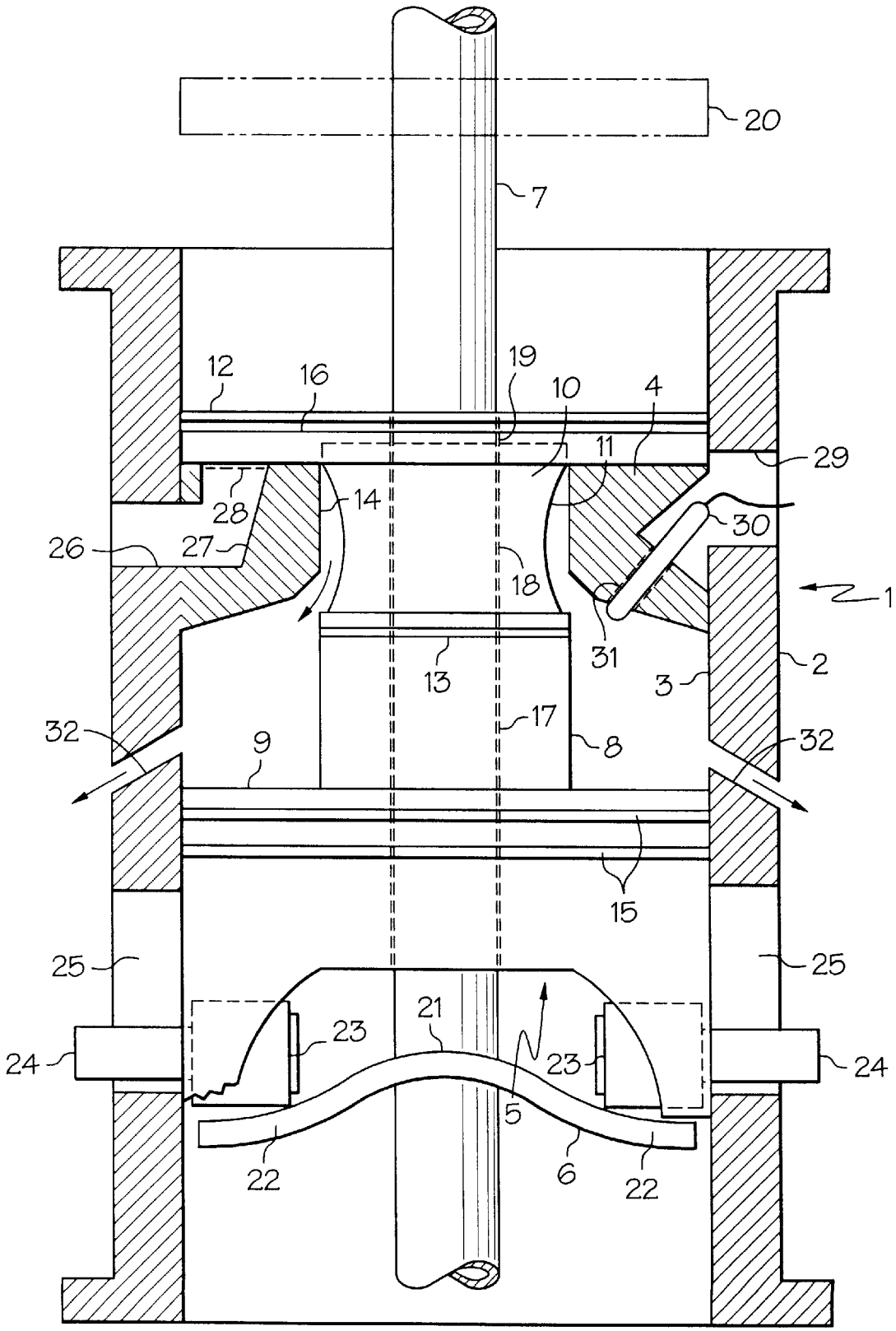
FIG. 3 represents a longitudinal view, partially in section, of the engine, similar to FIG. 1, showing the compound piston assembly at the bottom of its stroke.

Embodiment of FIGS. 1–3

Engine 1 comprises hollow circular cylinder 2 having central bore 3, circular cylinder head 4 fixedly mounted within cylinder 2, circular compound piston assembly 5 longitudinally movable within cylinder 2, and swash plate 6 secured to drive shaft 7.

Compound piston assembly 5, which may also be referred to as a two-diameter piston, is constituted by small diameter piston 8, hollow large diameter piston 9, and end piece 10 with recess 11 therein secured to the free end of small diameter piston 8. Circular plate 12 is threaded to the free end of end piece 10.

Compound piston assembly 5 is movable longitudinally in bore 3 of cylinder 2. Small diameter piston 8 slidably engages, through piston ring 13, central bore 14 in cylinder head 4. Large diameter piston 9 slidably engages, through piston rings 15, central bore 3 in cylinder 2. Plate 12 slidably engages, through piston ring 16, central bore 3 in cylinder 2. In assembling engine 1, it will be apparent that compound piston assembly 5 is first positioned in bore 3 of cylinder 2, after which plate 12 is threaded on to the free end of end piece 10 projecting above the top of cylinder head 4.

Drive shaft 7 extends through the hollow of large diameter piston 9, and through central bores 17, 18 and 19 in small diameter piston 8, end piece 10, and plate 12 respectively.

Flywheel 20, shown in phantom in the drawings, is secured to drive shaft 7.

Swash plate 6, otherwise known as a wobble plate, is formed with gradual slopes 21 extending in one direction away from the center of swash plate 6, and with gradual slopes 22 extending in the opposite direction away from the center of swash plate 6, the said gradual slopes 21 and gradual slopes 22 being arranged alternately in equispaced relation around the swash plate 6.

Swash plate 6 is positioned in cylinder 2 so that slopes 21 and 22 alternately engage roller bearings 23 rotatably mounted within the hollow of, and to, large diameter piston 9. It will be seen that, as swash plate 6 rotates, or is caused to rotate as will be explained further on in this specification, the alternate engagement of slopes 21 and 22 with roller bearings 23 coincides with the longitudinal movement of compound piston assembly 5 within cylinder 2.

In this preferred embodiment, swash plate 6 has two gradual slopes 21 and two gradual slopes 22 positioned alternately in equispaced relationship around the circumference of swash plate 6. In other words, slopes 21 and 22 are 90° apart. Slopes 21 on opposite edges of swash plate 6 must simultaneously engage roller bearings 23 which, as shown in FIGS. 1–3, are positioned 180° apart on opposite sides of the hollow in large diameter piston 9. Similarly, slopes 22 on opposite edges of swash plate 6 must simultaneously engage the said roller bearings 23.

The embodiment shown in FIGS. 1–3 may employ a swash plate 6 with additional pairs of slopes 21 and 22.

The distances between those surfaces of slopes 21 and 22 which engage roller bearings 23, as measured across, i.e. transverse to, swash plate 6 is equal to the length of travel of compound piston assembly 5 within cylinder 2.

Compound piston assembly 5 is provided with stabilizing rods 24 projecting into slots 25 in cylinder 2, thus preventing compound piston assembly from rotating within bore 3 of cylinder 2.

The fuel/air mixture which is burned within engine 1 is introduced into cylinder 2 through aperture 26 in cylinder 2 and aperture 27 in cylinder head 4. Check valve 28, which may for example be a reed valve or the like, is provided in aperture 27 to permit the fuel/air mixture to enter cylinder 2 and to prevent backflow of fuel/air mixture out of cylinder 2.

Aperture 29 in cylinder 2 permits the introduction of spark plug 30 through a threaded aperture 31 in cylinder head 4 so that the points of spark plug 30 are positioned in cylinder 2.

In operating the embodiment of engine 1 shown in FIGS. 1–3, with compound piston assembly 5 at the top of its stroke, fuel/air mixture is introduced, through apertures 26 and 27, as indicated diagrammatically by the arrow in FIG. 1, into the space between the bottom of plate 12 and the top of cylinder head 4. Due to the rotation of drive shaft 7, caused by a previous combustion cycle of operation, or by the momentum of fly wheel 20 in initially starting up engine 1, swash plate 6 rotates to remove the tops of slopes 21 away from engagement with roller bearings 23, and compound piston assembly descends in cylinder 2 as shown in FIG. 2. By the time compound piston assembly has reached the bottom of its stroke, as shown in FIG. 3, the fuel/air mixture has passed through the space between bore 14 of cylinder head 4 and end piece 10 into cylinder 2, small diameter piston 8 having cleared bore 14, and spark plug 30 has fired to combust the fuel/air mixture in cylinder 2, and exhaust gases resulting from such combustion are forced out of cylinder 2 through apertures 32, as indicated diagrammatically by the arrows in FIG. 3. Such combustion of the fuel/air mixture in cylinder 2 bears against the top of large diameter piston 9 forcing compound piston assembly down in the cylinder 2. Continued rotation of swash plate 6 caused by rotation of drive shaft 7 brings slopes 21 into engagement with roller bearings 23, thereby forcing compound piston assembly to the top of its stroke in preparation for the next cycle of operation.

Figure 4:
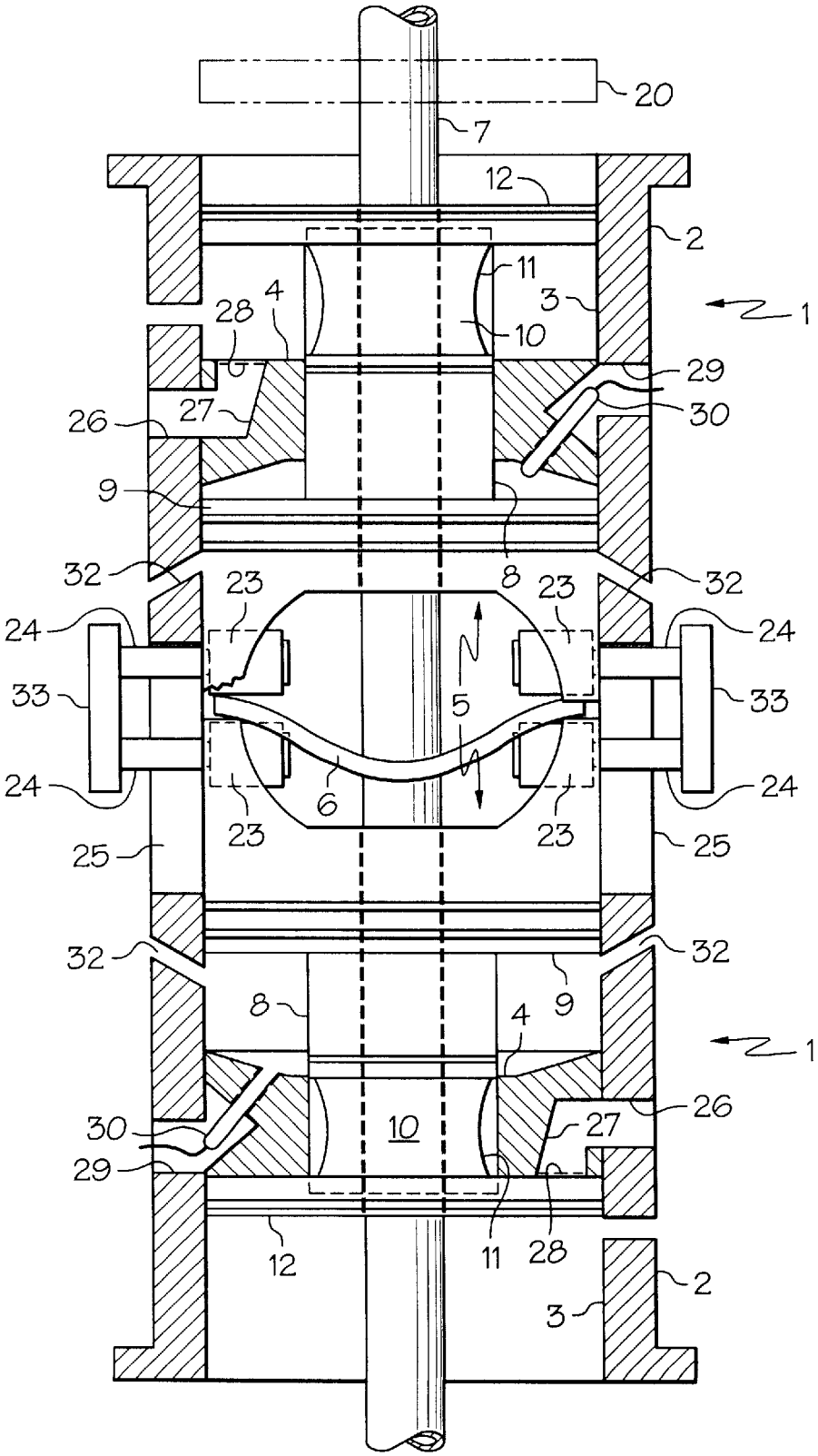
FIG. 4 represents a longitudinal view, partially in section, of another embodiment of the invention, in which the engines of FIGS. 1–3 are arranged in opposition engaging opposite sides of a single interposed swash plate, the compound piston assembly of one engine at the top of its stroke and the compound piston assembly of the other engine at the bottom of its stroke.

Embodiment of FIG. 4

In this embodiment, two engines 1 of the structure disclosed in FIGS. 1–3 are mounted in opposition about a single swash plate 6 interposed between the two engines 1. Drive shaft 7 extends through the hollows of both large diameter pistons 9, and through central bores 17, 18 and 19 in the small diameter piston 8, end piece 10 and plate 12, respectively, of both engines 1.

One side of swash plate 6 serves the roller bearings 23 of one of the engines 1, and the other side of swash plate 6 serves the roller bearings of the other of the two engines 1. More particularly, it will be seen from an inspection of FIG. 4 that slopes 21 on one side of swash plate 6 engage the roller bearings 23 of one of the two engines 1 to raise compound piston assembly 5 in the cylinder 2 of the said engine 1 to the top of its stroke, and on the side of swash plate 6 opposite said slopes 21 slopes 22 permit the compound piston assembly 5 of the other of the two engines 1 to descend in the cylinder 2 of the said engine 1 to the bottom of its stroke. To insure proper phasing of the two engines 1, the stabilizing rods 24 of the two engines 1 are secured to each other by means of members 33 as shown in FIG. 4.

The operation of the two engines 1 in the embodiment of FIG. 4 is otherwise identical to that described for the single engine 1 in FIGS. 1–3.

Figure 5:
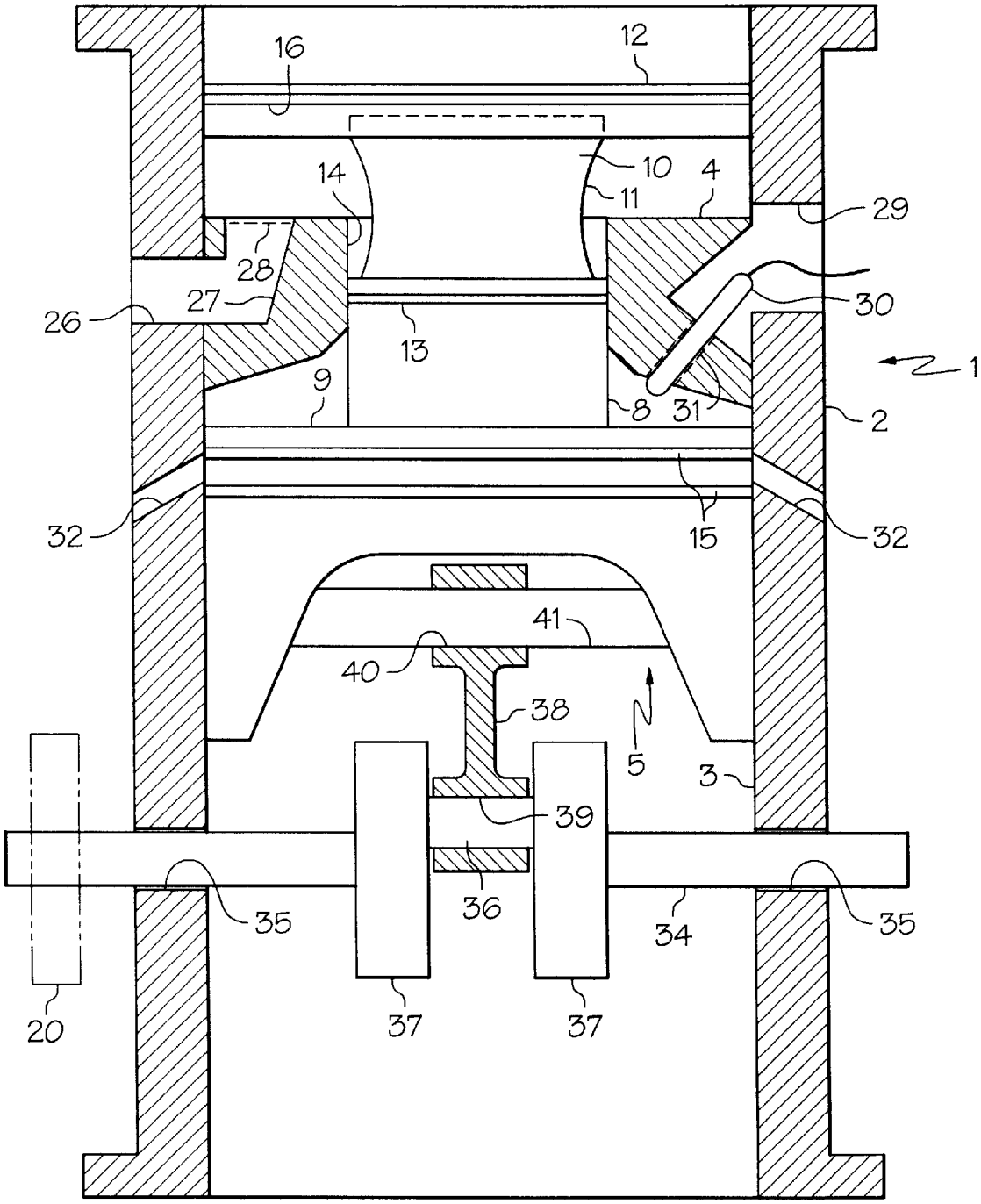
FIG. 5 represents a longitudinal medial view, partially in section, of another embodiment of the invention, showing the compound piston assembly at the top of its stroke.
Figure 6:
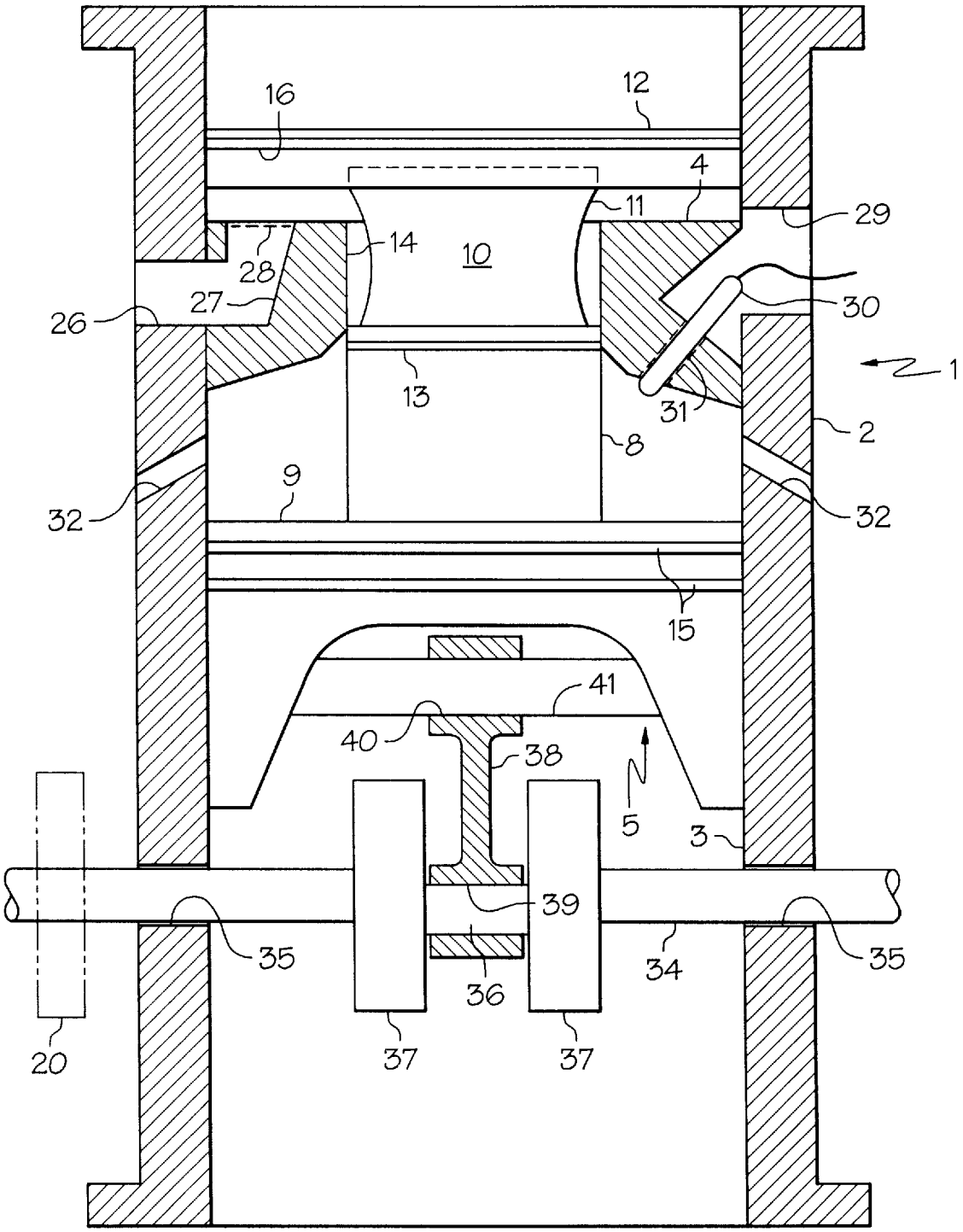
FIG. 6 represents a longitudial medial view, partially in section, similar to FIG. 5, showing the compound piston assembly at the bottom of its stroke.

Embodiment of FIGS. 5–6

In this embodiment, drive shaft 34 extends through apertures 35 in opposite sides of cylinder 2, and is provided with cam 36 bounded by side members 37. Crank 38 is provided at one end with aperture 39 receiving cam 36. The other end of crank 38 extends into the hollow of large diameter piston 9 and is provided with aperture 40. Rod 41, mounted to and within the hollow of large diameter piston 9, extends through aperture 40.

Rotation of drive shaft 34 causes cam 36, acting on crank 38, which in turns acts on rod 41, to raise compound piston assembly 9 to the top of its stroke and, alternatively to permit compound piston assembly 9 to descend to the bottom of its stroke.

In other respects, the operation of the embodiment of FIGS. 5–6 is identical to that of engine 1 of FIGS. 1–3.

Since modifications and changes which do not depart from the spirit of the invention as disclosed herein may readily occur to those skilled in the art to which this invention pertains, the appended claims should be construed as covering all suitable modifications and equivalents.

I claim:

1. Internal combustion engine comprising:

(a) a cylinder (b) a central bore in said cylinder (c) a piston in slidable engagement with the central bore of said cylinder (d) a roller bearing mounted to said piston (e) a drive shaft extending through said cylinder and through said piston (f) a swash plate secured to said drive shaft and engaging said roller bearing (g) whereby in one cycle of operation of said engine, movement of said piston within said cylinder causes the roller bearing secured thereto to rotate said swash plate and the drive shaft secured thereto, and in another cycle of operation of said engine rotation of said swash plate bearing against said roller bearing causes movement of said piston within said cylinder.

2. Internal combustion engine as in claim 1, further comprising:

(h) a slot in said cylinder (i) a stabilizing rod secured to said piston and extending into said slot, whereby to prevent said piston from rotating in said cylinder.

3. Internal combustion engine as in claim 1, wherein:

(h) said piston is hollow (i) said roller bearing is mounted to said piston within the hollow thereof.

4. Internal combustion engine as in claim 3, further comprising:

(j) a slot in said cylinder (k) a stabilizing rod secured to said piston and extending into said slot, whereby to prevent said piston from rotating in said cylinder.

5. A duplex internal combustion engine assembly comprising:

(a) a first internal combustion engine (b) a second internal combustion engine (c) said first and second internal combustion engines each comprising:

(i) a cylinder (ii) a central bore in said cylinder (iii) a piston in slidable engagement with the central bore of said cylinder (iv) a roller bearing mounted to said piston (d) a drive shaft extending through the cylinders and pistons of both said first and second engines (e) a swash plate interposed between said first and second engines and secured to said drive shaft (f) said swash plate having a first swashed face and a second swashed face opposite said first swashed face (g) the first swashed face of said swash plate engaging the roller bearing of said first engine (h) the second swashed face of said swash plate engaging the roller bearing of said second engine (i) whereby in one cycle of operation of one of said engines movement of its piston with its roller bearing engaging its respective swashed face of said swash plate causes said swash plate and the drive shaft secured thereto to rotate, and in another cycle of operation of the said engine rotation of said swash plate causes movement of the said piston towards the top of its stroke (j) and whereby when the piston of one of said engines is at the top of its stroke, the piston of the other of said engines is at the bottom of its stroke.

6. The duplex internal combustion engine assembly of claim 5, further comprising:

(k) a first slot in the cylinder of said first engine (l) a first stabilizing rod secured to the piston of said first engine and extending into said first slot (m) a second slot in the cylinder of said second engine (n) a second stabilizing rod secured to the piston of said second engine and extending into said second slot (o) whereby to prevent the pistons of said first and second engines from rotating in their respective cylinders.

7. The duplex internal combustion engine assembly of claim 6, further comprising:

(p) a member secured to said first and second stabilizing rods to tie the said stabilizing rods together.

8. The duplex internal combustion engine of claim 6, wherein:

(p) the pistons of said first and second engines are hollow (q) the roller bearings of said first and second engines are mounted to their respective pistons within the hollows of said pistons.

9. Internal combustion engine comprising:

(a) a cylinder (b) a central bore in said cylinder (c) a cylinder head mounted to said cylinder (d) a central bore in said cylinder head (e) a compound piston assembly comprising:

(i) a small diameter piston in slidable engagement with the central bore of said cylinder head (ii) a hollow large diameter piston in slidable engagement with the central bore of said cylinder (iii) roller bearings rotatably mounted within said hollow large diameter piston (iv) an end piece mounted to said small diameter piston and projecting through the central bore of said cylinder head (v) a peripheral recess extending around said end piece (vi) said end piece slidably engaging the central bore of said cylinder head (vii) a circular plate mounted to said end piece and slidably engaging the central bore of said cylinder (f) a drive shaft extending through said hollow large diameter piston, said small diameter piston, said end piece and said circular plate (g) a swash plate secured to said drive shaft and engaging said roller bearings (h) a first aperture in said cylinder for the introduction of a fuel/air mixture into the space between said cylinder head and said circular plate (i) a second aperture in said cylinder (j) a spark plug positioned in said second aperture and extending into the central bore of said cylinder (k) a third aperture in said cylinder for the discharge of exhaust gases (l) whereby fuel/air mixture introduced through said first aperture passes into the space between said cylinder head and said circular plate, and then as the compound piston assembly descends from the top of its stroke, said fuel/air mixture is forced by said circular plate through the space between the central bore of said cylinder head and the peripheral recess extending around said end piece, and finally into that portion of said cylinder below said cylinder head where combustion takes place (m) and whereby exhaust gases resulting from the combustion of said fuel/air mixture are discharged through said third aperture.

10. Internal combustion engine as in claim 9, further comprising:

(n) a slot in said cylinder (o) a stabilizing rod secured to said hollow large diameter piston and extending into said slot, thereby to prevent said compound piston assembly from rotating in said cylinder.

11. A duplex internal combustion engine assembly comprising:

(a) a first internal combustion engine (b) a second internal combustion engine (c) said first and second internal combustion engines each comprising:

(i) a cylinder (ii) a central bore in said cylinder (iii) a cylinder head mounted to said cylinder (iv) a central bore in said cylinder head (v) a compound piston assembly comprising:

a small diameter piston in slidable engagement with the central bore of said cylinder head a hollow large diameter piston in slidable engagement with the central bore of said cylinder roller bearings rotatably mounted within said hollow large diameter piston an end piece mounted to said small diameter piston and projecting through the central bore of said cylinder head a peripheral recess extending around said end piece said end piece slidably engaging the central bore of said cylinder head a circular plate mounted to said end piece and slidably engaging the central bore of said cylinder (d) a drive shaft extending through the hollow large diameter pistons, the smaller diameter pistons, the end pieces and the circular plates of said first and second engines (e) a swash plate interposed between said first engines and secured to said drive shaft (f) said swash plate having a first swashed face and a second swashed face opposite said first swashed face (g) the first swashed face of said swash plate engaging the roller bearings of said first engine (h) the second swashed face of said swash plate engaging the roller bearings of said second engine (i) whereby the swash plate and the drive shaft secured thereto are caused to rotate by the roller bearings of one of the compound piston assemblies (i) and whereby when the compound piston assembly of one of said engines is at the top of its stroke, the compound piston assembly of the other of said engines is at the bottom of its stroke.

12. A duplex internal combustion engine assembly as in claim 11, further comprising:

(j) a first slot in the cylinder of said first first engine (k) a first stabilizing rod secured to the piston of said first engine and extending into said first slot (l) a second slot in the cylinder of said second engine (m) a second stabilizing rod secured to the piston of said second engine and extending into said second slot (n) whereby to prevent the pistons of said first second engines from rotating in their respective cylinders.

13. A duplex internal combustion engine assembly as in claim 12, further comprising:

(o) a member secured to said first and second stabilizing rods to tie the said stabilizing rods together.

14. Internal combustion engine comprising:

(a) a cylinder (b) a central bore in said cylinder (c) a cylinder head mounted to said cylinder (d) a central bore in said cylinder head (e) a compound piston assembly comprising:

(i) a small diameter piston in slidable engagement with the central bore of said cylinder head (ii) a hollow large diameter piston in slidable engagement with the central bore of said cylinder (iii) an end piece mounted to said small diameter piston and projecting through the central bore of said cylinder head (iv) a peripheral recess extending around said end piece (v) said end piece slidably engaging the central bore of said cylinder head (vi) a circular plate mounted to said end piece and slidably engaging the central bore of said cylinder (f) a pair of first apertures in said cylinder positioned transversely across said cylinder (g) a drive shaft extending across said cylinder and rotatably received by said pair of first apertures (h) a cam on said drive shaft (i) a crank having a second aperture at one end and a third aperture at the opposite end (j) a rod extending across the hollow of said large diameter piston and into said pair of first apertures (k) the second aperture in said crank receiving said rod (l) the third aperture in said crank receiving said cam (m) a fourth aperture in said cylinder for the introduction of a fuel/air mixture into the space between said cylinder head and said circular plate (n) a fifth aperture in said cylinder (o) a spark plug positioned in said fifth aperture and extending into the central bore of said cylinder (p) a sixth aperture in said cylinder for the discharge of exhaust gases (q) whereby as the compound piston assembly descends from the top of its stroke, the said rod engaging the cam on the drive shaft causes the drive shaft to rotate, and the compound piston assembly is raised from the bottom of its stroke to the top of its stroke by the rotating drive shaft and the cam secured thereto raising the rod in the hollow of the piston (r) and whereby fuel/air mixture introduced through said fourth aperture passes into the space between said cylinder head and said circular plate, and then as the compound piston assembly descends from the top of its stroke, said fuel/air mixture is forced by said circular plate through the space between the central bore of said cylinder head and the peripheral recess extending around said end piece, and finally into that portion of said cylinder below said cylinder head where combustion takes place (s) and whereby exhaust gases resulting from the combustion of said fuel/air mixture are discharged through said sixth aperture.

15. A compound piston assembly for use in an internal combustion engine having a cylinder, a central bore in said cylinder, a cylinder head mounted to said cylinder, and a central bore in said cylinder head, said compound piston assembly comprising:

(a) a small diameter piston adapted to slidably engage the said central bore of the said cylinder head (b) a hollow large diameter piston adapted to slidably engage the said central bore of the said cylinder (c) an end piece mounted to the free end of said small diameter piston (d) a peripheral recess extending around said end piece (e) said end piece adapted to slidably engage the said central bore of the said cylinder head (f) a circular plate mounted to said end piece and adapted to slidably engage the said central bore of the said cylinder.

16. A compound piston assembly as in claim 15, further comprising:

(g) roller bearings mounted within the hollow of large diameter piston.

17. A compound piston assembly as in claim 15, further comprising:

(g) a stabilizing rod secured to said large diameter piston and adapted to extend into a slot in the said cylinder.

* * * * *